United States Patent [19]

Jean

[11] 4,052,115

[45] Oct. 4, 1977

[54] DEVICE FOR MANUFACTURING ELECTRON TUBE HAVING A RADIATION-SENSITIVE LAYER

[75] Inventor: Bernard Louis Pierre Jean, Fresnes, France

[73] Assignee: U.S. Philips Corporation, New York, N.Y.

[21] Appl. No.: 707,496

[22] Filed: July 22, 1976

Related U.S. Application Data

[63] Continuation of Ser. No. 596,660, July 17, 1975, abandoned.

[30] Foreign Application Priority Data

Aug. 2, 1974 France ..... 72.26925

[51] Int. Cl.[2] ..... H01J 9/34

[52] U.S. Cl. ..... 316/31; 316/19

[58] Field of Search ..... 316/17, 18, 19, 20, 316/21, 31; 220/2.1 R

[56] References Cited

U.S. PATENT DOCUMENTS

| | | | |
|---|---|---|---|
| 2,684,777 | 7/1954 | Danzin et al | 220/2.1 R |
| 3,038,731 | 6/1962 | Milleron | 277/22 |
| 3,853,374 | 12/1974 | Flasche et al. | 316/19 |

*Primary Examiner*—Richard B. Lazarus
*Attorney, Agent, or Firm*—Frank R. Trifari

[57] ABSTRACT

During the manufacture of an electron tube having a radiation-sensitive layer, several components of the tube are subjected to a treatment in auxiliary evacuated containers which are sealed hermetically temporarily by means of interchangeable closing members. The auxiliary containers are accommodated in a common container which comprises means which can be controlled from outside to open and close the auxiliary containers accommodated therein. After evacuating the common container the auxiliary containers are opened and the tube is assembled and sealed finally by means of one of the closing members while using a seal consisting of a gallium-containing material in the liquid state. Finally the vacuum in the common container is broken and the finished tube is removed.

1 Claim, 3 Drawing Figures

DEVICE FOR MANUFACTURING ELECTRON TUBE HAVING A RADIATION-SENSITIVE LAYER

Figure 1:
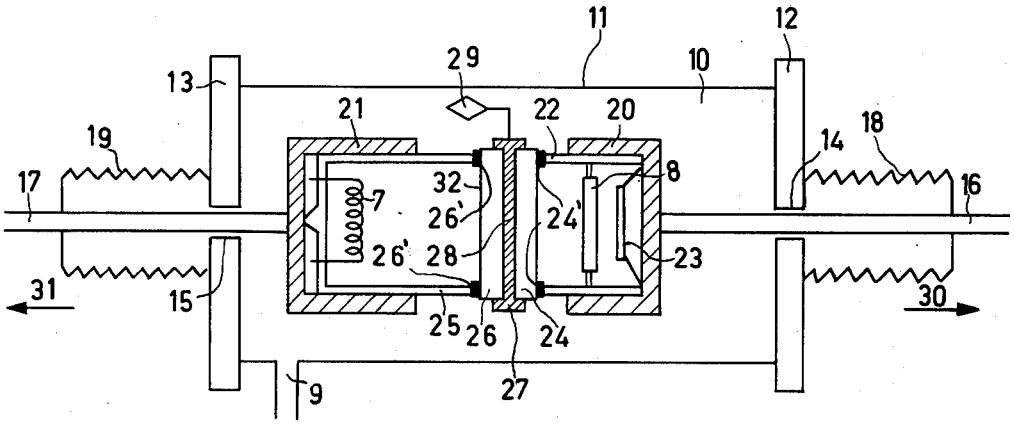

This is a continuation of application Ser. No. 596,660, filed July 17, 1975, now abondoned.

The invention relates to a method of manufacturing an electron tube having an envelope consisting of at least two parts sealed hermetically relative to each other and a layer of radiation-sensitive material provided on at least one of the said parts, various components of the tube being subjected to a treatment in separate containers.

The invention furthermore relates to a device for carrying out said method, as well as to a tube obtained according to said method.

In the manufacture of electric discharge tubes it frequently occurs that certain components of the tube should be subjected to treatments which have an undesired and often detrimental influence on other components of the tube. For that reason it is desired that the components in question are subjected to the required treatments in separate containers before they are composed to form a tube. The additional particular problem may occur that the components after the treatment may no longer be exposed to atmospheric influences. A known example thereof is to be found in the manufacture of electric discharge tubes having a certain radiation-sensitive layer, for example, television camera tubes and photomultiplier tubes. It is known that the properties of the radiation-sensitive material as regards, for example, the sensitivity or the inertia can vary adversely when they are exposed to the atmosphere.

U.S. Pat. No. 3,334,955 discloses a method of manufacturing a vacuum tube in which the components of the tube are composed in an evacuated container after having been subjected to various treatments in separate containers. Said containers are temporarily closed by means of a metal foil and are opened again in an evacuated common container by cutting said foil from an annular frame.

German Pat. No. 1,915,710 discloses a method of manufacturing a television camera tube in which a photo-cathode is vapour-deposited on a window in a closed first container comprising said window. The first container together with the electrode system of the camera tube which has already been assembled in an envelope which is open at one end, is then accommodated in a common container communicating with an evacuating apparatus. After evacuating the common container the electrode system is degassed after which the window having a radiation-sensitive layer is removed from the said first container by means of a thermo-shock treatment and is then placed on the open end of the envelope of the camera tube with the interposition of an indium sealing ring.

The methods which are used in the known modes of manufacture to obtain a temporary seal of the containers are far from ideal. The seals can be used only once and require expensive and precise pretreatments.

The invention is based on the above-described methods and has for its object to provide an improved method of manufacturing an electric discharge tube.

According to the invention, a method of manufacturing an electron tube of the kind mentioned in the preamble is characterized in that the radiation-sensitive material is provided on the relevant part of the tube envelope in a first container closed temporarily for that purpose with said part of the tube envelope while using a seal consisting of a gallium-containing material in the liquid state, that the other components of the tube are accommodated for a possible treatment in a second container the envelope of which consists of the complementary part of the final tube envelope which is closed temporarily by means of an auxiliary closing member while using a seal consisting of a gallium-containing material in the liquid state, that the said first container and second container are accommodated in a common third container and are opened therein under a vacuum by breaking the said seals, after which the part of the tube envelope covered with the radiation-sensitive material is transferred to the said complementary part of the tube envelope and is sealed relative to it while using a final seal consisting of a gallium-containing material in the liquid state, after which finally the vacuum in the said third container is removed and the finished tube is removed therefrom.

It is to be noted that gallium seals as such are known from the U.S. Pat. No. 3,038,731, in particular with respect to liquid seals for valves and parts arranged so as to be rotatable relative to each other. As described in said Patent Specification, the sealing action of gallium and low-melting-point alloys of gallium is based on an equilibrium of forces between on the one hand the surface forces of the sealing material and on the other hand the force acting on said material as a result of the pressure differential across the seal. This equilibrium may exist as long as with a given pressure differential the distance between the surfaces of the parts to be connected does not exceed a given value. In the pratical case in which the pressure differential across the seal is approximately one atmosphere, this means that the maximum distance of the parts to be connected may not exceed approximately 10 μum with a surface tension of the sealing material of approximately 500 dyn/cm.

The advantages of the low melting temperature of the gallium (approximately 29° C) are that producing the seal requires neither high temperature nor high pressures.

Furthermore, such seals cannot only be realized in a simple manner, but breaking the seals can also be carried out again easily without damaging the components of the tube. It is just these properties that make such seals extremely suitable for use thereof as temporary seals.

Examples of low-melting-point alloys which satisfy the object underlying the invention are alloys of gallium and at least one of the metals indium and tin containing at least 50% by weight of gallium and in particular eutectic alloys of gallium, indium and tin the melting point of which is below room temperature.

Figure 2:
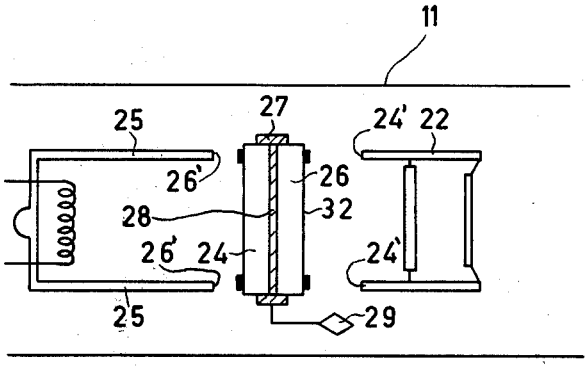
Figure 3:
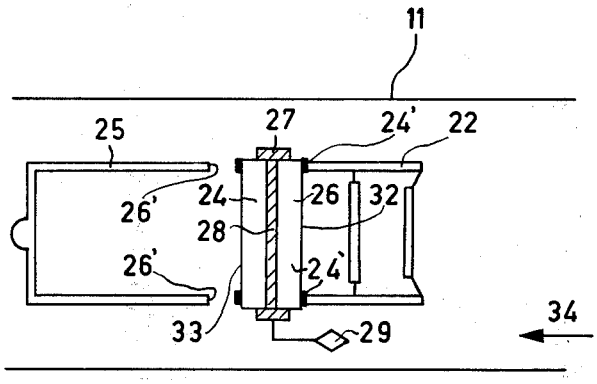

In order that the invention may be readily carried into effect, it will now be described in greater detail, by way of example, with reference to the accompanying drawing, in which:

FIG. 1 is a sectional view of a device for manufacturing a photoelectric tube according to the invention, FIG. 2 shows a first stage of the manufacturing process, while FIG. 3 shows a later stage.

The container 10 shown in FIG. 1 comprises a cylinderical member 11 having an exhaust tube 9 and sealed hermetically at either end by means of sealing plates 12 and 13. Both sealing plates have apertures 14 and 15, respectively, through which two shafts 16 and 17, present in the elongation of each other are threaded. By means of the bellows seals 18 and 19 the shafts 16 and 17 can be moved in the longitudinal direction without disturbing any vacuum prevailing in the container 10. At their ends present in the container 10 the shafts 16 and 17 have cylindrical holders 20 and 21 the longitudinal axes of which coincide with those of the shafts 16 and 17. A third holder 27 is arranged so as to be rotatable about a shaft 28 intersecting the shafts 16 and 17 at right angles. The holder 27 consists of a cylindrical member which is open at either end and has a partition between said ends. Thus a cavity is present on either side of said partition in which disc-shaped members 24 and 26, respectively, can be dumped. The said holder can be tilted about the shaft 28 by means of a weight 29 connected to the edge of the holder 27.

The operation of the device shown in FIG. 1 will be explained with reference to the manufacture of an image intensifier tube.

The envelope of the image intensifier tube comprises a glass cylindrical envelope 22 closed at one end by means of a window 23 having a luminescent screen emitting light in the places were electrons impinge upon it. The envelope 22 furthermore comprises an electron multiplier 8, for example a micro-channel plate. The envelope 22 is placed in the holder 20 in the position as is shown in the drawing. A cylindrical envelope 25 which is open at one end and has a vapour deposition device 7 to form a photocathode is placed in the second holder 21. The open ends of both the envelope 22 and the envelope 25 have smooth edges 24' and 26', respectively, each wetted with gallium or an alloy of gallium the melting point of which is lower than the ambient temperature. A glass sealing plate 26 which afterwards forms part of the final envelope of the image intensifier tube is pressed against the edge 26' with the interposition of the gallium as a seal, after which the envelope 25 is evacuated via an exhaust tube not shown in the drawing. A photocathode is then vapour-deposited on the sealing plate 26 by means of the vapour deposition device 7. In a manner analogous to that described above, the envelope 22 is sealed hermetically and evacuated by means of the auxiliary sealing plate using gallium as a seal. The components of the image intensifier tube present in the envelope 22 are now degassed without affecting the photocathode 32. In a subsequent phase of the manufacturing process, the two holders 20 and 21 with the components they contain are accommodated in the container 10, the sealing plates 24 and 26 being clamped in the cavities of the holder 27 destined for that purpose. After hermetically closing the space 10 by means of the sealing plates 12 and 13, said container is evacuated via the exhaust tube 9. Since now the same pressure prevails both inside and outside the envelopes 22 and 25, the seals obtained by means of the gallium can be broken easily by moving the shafts 16 and 17 in the direction denoted by the arrows 30 and 31. The weight 29 which initially is in an upper position, will then assume a lower position under the influence of gravity, the holder 27 tilting about the shaft 28 and the sealing plate 26 having the photocathode 32 being placed opposite to the opened end of the envelope 22. This stage of the manufacture is shown in FIG. 2. The last phase of the manufacture of the tube is shown in FIG. 3. The shaft 16 is moved in the direction denoted by the arrow 34 until the sealing plate 26 bears against the edge 24'. The gallium which initially ensured the temporary seal of the envelopes 22 and 25 now ensures the final seal of the tube which is herewith completed and can be removed from the container 10 after removing the vacuum therefrom. The pressure differential across the seal of the tube keeps the sealing plate 26 pressed hermetically against the edge 24' of the envelope 22. Any lateral movement of the sealing plate relative to the envelope can be avoided by locking the parts against shifting, for example, by providing around the envelope a metal ring which roofs the seal.

I claim:

1. A device for manufacturing an electron tube having an envelope assembled of a tubular portion and a window portion hermetically sealed together, a system of electrodes within said envelope and a radiation sensitive layer provided on said window portion, said device comprising: a common container in which a first and a second evacuated container are accomodated, means operable to maintain said common container evacuated said first container including means to construct the radiation sensitive layer on the window portion and being temporarily closed by that window portion using a first vacuum seal of a gallium containing material in the liquid state, said second container consisting of the tubular portion including the system of electrodes and being temporarily closed by an auxiliary closing member using a second vacuum seal of the gallium containing material in the liquid state, said device having two shafts extending collinearly through respective apertures in opposed walls of the common container, the shafts having at their ends which are within the container holders holding said first and second containers respectively, the device further comprising a third holder disposed between the holders at the ends of said shafts and which is operable to hold the window portion of the tube envelope and to hold said auxiliary closing member, means operable to move said first and second shafts longitudinally whereby the first and second vacuum seals are broken by moving the shafts longitudinally apart while leaving the window portion and the auxiliary closing member in the third holder, means operable to rotate the third holder about an axis perpendicular to the shafts whereby the window portion having the radiation sensitive layer constructed thereon is rotated to face the then open end of the tubular portion of the tube envelope, and means creating a final vacuum seal consisting of the gallium containing material in the liquid state by moving the shaft holding the tubular portion towards the third holder effecting pressured contact between the window portion and the opened end of the tubular portion.

* * * * *

UNITED STATES PATENT AND TRADEMARK OFFICE

CERTIFICATE OF CORRECTION

PATENT NO. : 4,052,115

DATED : October 4, 1977

INVENTOR(S) : BERNARD LOUIS PIERRE JEAN

It is certified that error appears in the above-identified patent and that said Letters Patent are hereby corrected as shown below:

In the Title Page, Section [30], "72.26925" should be

--74.26925--

Column 2, line 36, "µum" should be --µm--

Column 3, line 13, "dumped" should be --clamped--

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*